US009605664B2

(12) United States Patent
Seith

(10) Patent No.: US 9,605,664 B2
(45) Date of Patent: Mar. 28, 2017

(54) PNEUMATIC PISTON PUMP METERING AND DISPENSE CONTROL

(71) Applicant: Ingersoll-Rand Company, Davidson, NC (US)

(72) Inventor: Warren A. Seith, Bethlehem, PA (US)

(73) Assignee: Ingersoll-Rand Company, Davidson, NC (US)

( * ) Notice: Subject to any disclaimer, the term of this patent is extended or adjusted under 35 U.S.C. 154(b) by 467 days.

(21) Appl. No.: 14/148,986

(22) Filed: Jan. 7, 2014

(65) Prior Publication Data

US 2015/0192115 A1 Jul. 9, 2015

(51) Int. Cl.

| | |
|---|---|
| ***F04B 43/06*** | (2006.01) |
| ***F04B 43/073*** | (2006.01) |
| ***F04B 9/125*** | (2006.01) |
| ***F04B 9/105*** | (2006.01) |
| ***F04B 9/107*** | (2006.01) |
| ***F04B 49/06*** | (2006.01) |

(52) U.S. Cl.

CPC ..... *F04B 9/1256* (2013.01); *F04B 9/105* (2013.01); *F04B 9/107* (2013.01); *F04B 43/06* (2013.01); *F04B 43/073* (2013.01); *F04B 49/065* (2013.01); *F04B 2201/0201* (2013.01); *F04B 2203/0903* (2013.01)

(58) Field of Classification Search

CPC F04B 43/06; F04B 43/073; F04B 2201/0201; F04B 2203/0903; F04B 2205/05

USPC ..... 417/384

See application file for complete search history.

(56) References Cited

U.S. PATENT DOCUMENTS 4,023,592 A 5/1977 Patzke et al.
4,046,287 A 9/1977 Hoekstra et al.
(Continued)

FOREIGN PATENT DOCUMENTS

CN 1079027 A 12/1993
DE 3129365 A1 2/1983
(Continued)

OTHER PUBLICATIONS

Wennstrom Flow Control, "LO-W8 Additive Injector," published prior to Jan. 7, 2014, 2 pages.
(Continued)

*Primary Examiner* — Peter J Bertheaud
(74) *Attorney, Agent, or Firm* — Barnes & Thornburg LLP

(57) ABSTRACT

Illustrative embodiments of pump systems and methods are disclosed. In at least one embodiment, an apparatus comprises a piston pump including a motor and a plunger, where the motor is configured to drive linear reciprocating motion of the plunger in response to being supplied with a flow of compressed fluid, a metering valve fluidly coupled to the motor, the metering valve being configured to control the flow of compressed fluid to the motor, a purge valve fluidly coupled between the metering valve and the motor, a linear encoder coupled to the piston pump, the linear encoder configured to generate sensor data indicative of a position of the plunger, and an electronic controller operatively coupled to the metering valve, the purge valve, and the linear encoder, where the electronic controller is configured to receive sensor data from the linear encoder and to control the metering valve and the purge valve.

17 Claims, 5 Drawing Sheets

(56) References Cited

U.S. PATENT DOCUMENTS

| | | | | |
|---|---|---|---|---|
| 4,161,308 | A | 7/1979 | Bell et al. | |
| 4,702,674 | A | 10/1987 | Fontaine et al. | |
| 4,828,464 | A * | 5/1989 | Maier | F04B 43/067 324/207.21 |
| 5,996,650 | A | 12/1999 | Phallen et al. | |
| 6,126,403 | A * | 10/2000 | Yamada | F04B 43/0081 417/395 |
| 6,637,625 | B1 | 10/2003 | Jefferson | |
| 6,913,166 | B2 | 7/2005 | Cline et al. | |
| 6,939,111 | B2 | 9/2005 | Huitt et al. | |
| 7,311,502 | B2 * | 12/2007 | Gerhardt | F04B 9/113 417/388 |
| 7,823,411 | B2 | 11/2010 | Gagliano et al. | |
| 7,905,710 | B2 | 3/2011 | Wang et al. | |
| 8,025,486 | B2 | 9/2011 | Gonnella et al. | |
| 8,029,454 | B2 | 10/2011 | Kelly et al. | |
| 8,376,999 | B2 | 2/2013 | Busby et al. | |
| 8,403,880 | B2 | 3/2013 | Hopping et al. | |
| 2005/0232069 | A1 | 10/2005 | Jung | |
| 2007/0040454 | A1 | 2/2007 | Freudenberger et al. | |
| 2007/0175916 | A1 | 8/2007 | Oldham | |
| 2007/0177998 | A1 * | 8/2007 | Kato | F04B 7/02 417/395 |
| 2008/0022765 | A1 | 1/2008 | Witt et al. | |

FOREIGN PATENT DOCUMENTS

| | | | |
|---|---|---|---|
| EP | 0628390 | A1 | 12/1994 |
| JP | S6173024 | A | 4/1986 |
| WO | WO8501993 | | 5/1985 |

OTHER PUBLICATIONS

Groenveld Transport Efficiency B.V., "General Manual: Single Line Automatic Greasing Systems," Jan. 2004, 58 pages.

Graco Inc., "Operation and Maintenance: PR70 2 Component Liquid Dispensing Systems," Nov. 2013, 50 pages.

Hilger U. Kern / DOPAG Group, "Booster-Mix P80," Aug. 2006, 3 pages.

Hilger U. Kern / DOPAG Group, "DOPAG Metering and Mixing System for Low to Medium Viscosity Media: ECONO-Mix C," Jul. 2007, 4 pages.

Hilger U. Kern / DOPAG Group, "DOPAG Metering and Mixing System for Low to High Viscosity Media: VARIO-Mix A," Sep. 2006, 4 pages.

Hilger U. Kern / DOPAG Group, "DOPAG Metering and Mixing System for Low to High Viscosity Media: VARIO-Mix H," Sep. 2006, 4 pages.

Hilger U. Kern / DOPAG Group, "DOPAG Metering and Mixing System for Low to High Viscosity Media: VARIO-Mix S," Sep. 2006, 4 pages.

Hilger U. Kern / DOPAG Group, "DOPAG Metering and Mixing System for Silicone: SILCO-Mix P1," Aug. 2006, 3 pages.

Hilger U. Kern / DOPAG Group, "DOPAG Metering and Mixing System for Medium to High Viscosity Media: VISCO-Mix H200," Aug. 2006, 3 pages.

Hilger U. Kern / DOPAG Group, "DOPAG Metering and Mixing for Medium to High Viscosity Media: VISCO-Mix P80," Aug. 2006, 3 pages.

Hilger U. Kern / DOPAG Group, "Metering Technology: Shotmix," Jun. 2010, 6 pages.

Hilger U. Kern / DOPAG Group, "DOPAG Metering and Mixing System for Low to Medium Viscosity Media: Micro-Mix S," Sep. 2006, 4 pages.

Hilger U. Kern / DOPAG Group, "DOPAG Metering and Mixing System for Low to Medium Viscosity Media: Micro-Mix E," Sep. 2006, 4 pages.

Hilger U. Kern / DOPAG Group, "DOPAG Metering and Mixing System for Low to Medium Viscosity Media: Micro-Mix A/E," Sep. 2007, 4 pages.

Chinese Patent Application No. 201510006898. "Pneumatic Piston Pump Metering and Dispense Control," Office Action Dated May 30, 2016 with English Translation.

* cited by examiner

PNEUMATIC PISTON PUMP METERING AND DISPENSE CONTROL

TECHNICAL FIELD

The present disclosure relates, generally, to pump systems and methods and, more particularly, to metering and dispense control systems for pneumatic piston pumps.

BACKGROUND

Pneumatically powered piston pumps are robust and versatile systems for delivering a wide variety of fluid or semifluid materials. In general, a pneumatic piston pump includes an air motor powered by compressed air that drives a piston to pump a fluid media. Piston pumps are capable of generating relatively high fluid pressures and therefore may be used to pump higher viscosity fluids. Typical piston pumps may be used in industrial processes to deliver oil, grease, adhesives, sealants, potting, bonding agents, or any other fluid to a point of application. Additionally, typical piston pumps include simple on/off control—fluid is pumped when an operator supplies compressed air to the pump, and pumping stops when the compressed air is no longer supplied.

Current metering and dispense systems for delivering medium- to high-viscosity fluids use machined components such as servo controlled gear pumps, shot feeders, or precision valve systems to deliver the fluid. The precision-machined components of typical metering and dispense systems are expensive and have a high part count.

SUMMARY

According to one aspect, apparatus may comprise a piston pump including a motor and a plunger, wherein the motor is configured to drive linear reciprocating motion of the plunger in response to being supplied with a flow of compressed fluid; a metering valve fluidly coupled to the motor, the metering valve being configured to control the flow of compressed fluid to the motor; a purge valve fluidly coupled between the metering valve and the motor; a linear encoder coupled to the piston pump, the linear encoder configured to generate sensor data indicative of a position of the plunger; and an electronic controller operatively coupled to the metering valve, the purge valve, and the linear encoder, wherein the electronic controller is configured to receive sensor data from the linear encoder and to control the metering valve and the purge valve.

In some embodiments, the electronic controller may be configured to transmit a first control signal to cause the metering valve to permit the flow of compressed fluid to the motor, determine a dispensed volume of a fluid media pumped by the piston pump as a function of the sensor data and a volume-distance calibration factor, modify the first control signal, in response to determining that the dispensed volume is equal to or greater than a target volume, to cause the metering valve to block the flow of compressed fluid to the motor, and transmit a second control signal, in response to determining that the dispensed volume is equal to or greater than a target volume, to cause the purge value to vent compressed fluid from the motor. The electronic controller may be further configured to modify the second control signal, in response to determining that the linear reciprocating motion of the plunger has stopped, to cause the purge valve to cease venting compressed fluid from the motor.

In some embodiments, the apparatus may further comprise a pressure sensor fluidly coupled to an outlet of the piston pump and operatively coupled to the electronic controller. The pressure sensor may be configured to generate pressure data indicative of a pressure of the fluid media pumped by the piston pump, and the electronic controller may be configured to determine that the linear reciprocating motion of the plunger has stopped when the pressure data indicates that the pressure of the fluid media has reached a threshold value. The electronic controller may be configured to determine the dispensed volume, in part, by disregarding a distance moved by the plunger between an end-of-stroke position and a pump-start position.

In some embodiments, the electronic controller may be further configured to transmit a control signal to cause the metering valve to permit the flow of compressed fluid to the motor, determine a volumetric flow rate of a fluid media pumped by the piston pump as a function of the sensor data and a volume-distance calibration factor, and modify the control signal as a function of the determined volumetric flow rate and a target volumetric flow rate. The electronic controller may be configured to determine the volumetric flow rate, in part, by disregarding a distance moved by the plunger between an end-of-stroke position and a pump-start position.

In some embodiments, the apparatus may further comprise a pressure sensor fluidly coupled to an outlet of the piston pump and operatively coupled to the electronic controller. The pressure sensor may be configured to generate pressure data indicative of a pressure of a fluid media pumped by the piston pump. The electronic controller may be configured to transmit a first control signal to cause the metering valve to permit the flow of compressed fluid to the motor, determine the pressure of the fluid media pumped by the piston pump using the pressure data received from the pressure sensor, and modify the first control signal as a function of the determined pressure and a target pressure.

In some embodiments, the electronic controller may further configured to modify the first control signal, in response to the determined pressure being equal to or greater than the target pressure, to cause the metering valve to block the flow of compressed fluid to the motor, and transmit a second control signal, in response to the determined pressure being equal to or greater than the target pressure, to cause the purge value to vent compressed fluid from the motor. The electronic controller may be further configured to modify the second control signal, in response to determining that the linear reciprocating motion of the plunger has stopped, to cause the purge valve to cease venting compressed fluid from the motor.

In some embodiments, the metering valve may comprise a plurality of solenoid valves fluidly coupled in a parallel network. The electronic controller may be configured to transmit one or more control signals that selectively open or close each of the plurality of solenoid valves to control the flow of compressed fluid to the motor.

According to another aspect, a method may comprise transmitting a first control signal to a metering valve to cause the metering valve to supply compressed fluid to a motor of a piston pump such that the motor drives linear reciprocating motion of a plunger of the piston pump; receiving sensor data from a linear encoder coupled to the piston pump, the sensor data being indicative of a position of the plunger of the piston pump; determining a dispensed volume of a fluid media pumped by the piston pump as a function of the sensor data and a volume-distance calibration factor; modifying the first control signal, in response to determining that the dispensed volume is equal to or greater than a target volume, to cause the metering valve to cease supplying compressed fluid to the motor; and transmitting a second control signal, in response to determining that the dispensed volume is equal to or greater than a target volume, to a purge valve fluidly coupled between the metering valve and the motor to cause the purge value to vent compressed fluid from the motor.

In some embodiments, the method may further comprise modifying the second control signal, in response to determining that the linear reciprocating motion of the plunger has stopped, to cause the purge valve to cease venting compressed fluid from the motor. Determining the dispensed volume may comprise detecting the plunger reaching an end-of-stroke position using the sensor data, detecting the plunger reaching a pump-start position using the sensor data, and disregarding a distance moved by the plunger between the end-of-stroke position and the pump-start position.

In some embodiments, determining the dispensed volume may comprise receiving pressure data from a pressure sensor coupled to an outlet the piston pump, the pressure data being indicative of a pressure of the fluid media pumped by the piston pump, and disregarding a distance moved by the plunger until the pressure data indicates that the pressure of the fluid media has reached a threshold value. The method may further comprise transmitting a second control signal that causes a second piston pump to pump a volume of fluid media that is proportional to the dispensed volume.

According to yet another aspect, a method may comprise transmitting a control signal to a metering valve to cause the metering valve to supply compressed fluid to a motor of a piston pump such that the motor drives linear reciprocating motion of a plunger of the piston pump; receiving sensor data from a linear encoder coupled to the piston pump, the sensor data being indicative of a position of the plunger of the piston pump; determining a volumetric flow rate of a fluid media pumped by the piston pump as a function of the sensor data and a volume-distance calibration factor; and modifying the control signal as a function of the determined volumetric flow rate and a target volumetric flow rate.

In some embodiments, determining the volumetric flow rate may comprise detecting the plunger reaching an end-of-stroke position using the sensor data, detecting the plunger reaching a pump-start position using the sensor data, and disregarding a distance moved by the plunger between the end-of-stroke position and the pump-start position. In other embodiments, determining the volumetric flow rate may comprise receiving pressure data from a pressure sensor coupled to an outlet the piston pump, the pressure data being indicative of a pressure of the fluid media pumped by the piston pump and disregarding a distance moved by the plunger until the pressure data indicates that the pressure of the fluid media has reached a threshold value. The method may further comprise transmitting a second control signal that causes a second piston pump to pump fluid media at a volumetric flow rate proportional to the determined volumetric flow rate.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION OF THE DRAWINGS

Figure 1:
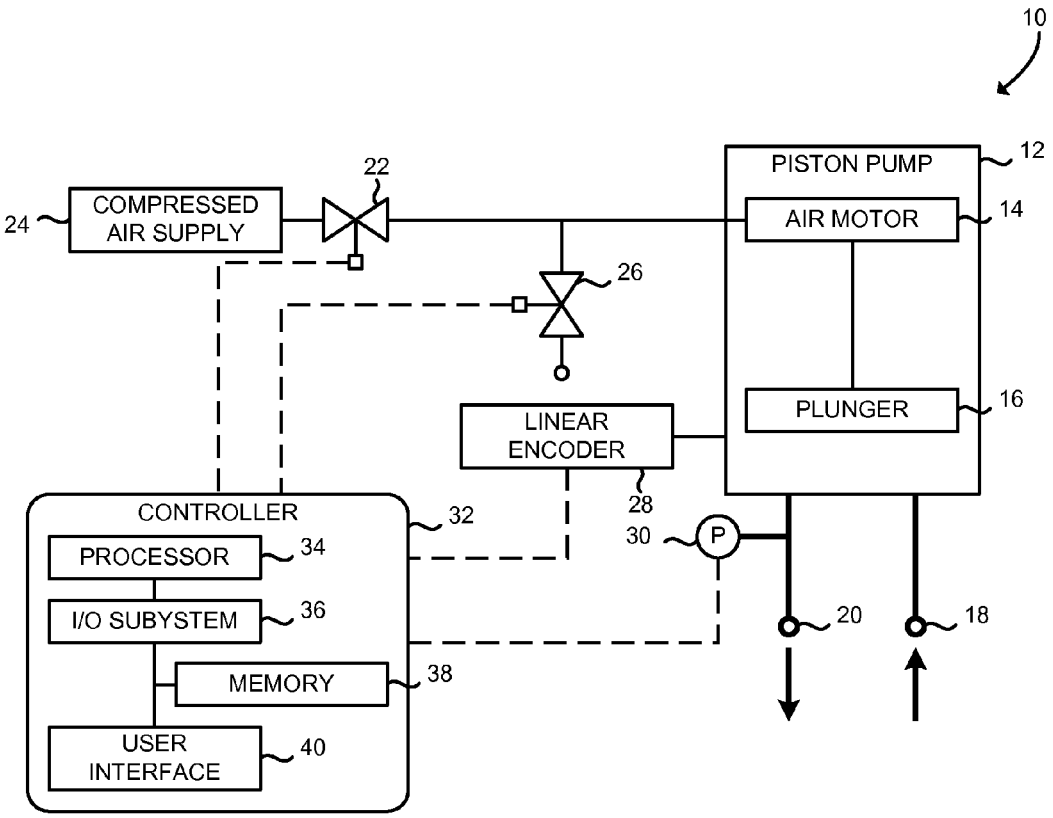
FIG. 1 is a simplified block diagram of at least one embodiment of a metering and dispense control system for a pneumatic piston pump.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Referring now to FIG. 1, one illustrative embodiment of a pump system 10 is shown as a simplified block diagram. The pump system 10 includes a piston pump 12, which itself includes an air motor 14 connected to a plunger 16. When compressed air is supplied to the air motor 14, the air motor 14 drives reciprocating linear motion of the plunger 16. The air motor 14 may include a reciprocating piston and valving system that allows the air motor 14 to develop power on both the upstroke and the downstroke. Although illustrated as including an air motor 14, in other embodiments, the piston pump 12 may include a motor powered by any other compressed fluid, for example a hydraulic motor.

The plunger 16 is a positive displacement pump that uses reciprocating mechanical motion to pump a fluid media. As the plunger 16 moves back and forth within the piston pump 12, fluid enters the piston pump 12 through a media inlet 18 and is pumped out through a media outlet 20. The piston pump 12 may further include a cylinder coupled with a series of check valves, ball valves, chop-checks, or other fluid control devices to control the fluid flow from the media inlet 18 to the media outlet 20. In some embodiments, the piston pump 12 may be a double-acting pump, that is, fluid may be pumped when the plunger 16 moves in either direction (the upstroke and the downstroke). In other embodiments, the piston pump 12 may be a single-acting pump, that is, fluid may be pumped only when the plunger 16 moves in one direction (e.g., the downstroke). The mechanical advantage available to the piston pump 12 is related to the ratio of the diameter of a piston of the air motor 14 to the diameter of the plunger 16. The plunger 16 may be directly connected to a piston of the air motor 14, or may be connected using a mechanical linkage such as a rod. In some embodiments, the air motor 14 and/or the plunger 16 may be modular components, allowing the piston pump 12 to be customized to a particular application.

The piston pump 12 is fluidly coupled to a metering valve 22. The metering valve 22 is further fluidly coupled to a compressed air supply 24. The compressed air supply 24 is the main motive power source for the piston pump 12, and may include one or more compressors, filters, compressed air storage tanks, lubrication systems, and other components typical of an industrial compressed air system. When the metering valve 22 is opened, compressed air is allowed to flow from the compressed air supply 24 to the piston pump 12, which causes the air motor 14 to drive the plunger 16, pumping fluid. When the metering valve 22 is closed, the flow of compressed air to the piston pump 12 is blocked, stopping the piston pump 12. The metering valve 22 is electronically controllable. In some embodiments, the metering valve 22 may be an on/off valve controlled by a digital signal. In other embodiments, the metering valve 22 may be a variable flow valve controlled by an analog signal or an encoded digital signal. Additionally or alternatively, the metering valve 22 may include a network of solenoid valves as described further below in connection with FIG. 2.

The pump system 10 also includes a purge valve 26 fluidly coupled between the metering valve 22 and the piston pump 12. The purge valve 26 is an on/off valve controlled by a digital signal. When opened, the purge valve 26 vents compressed air from the air motor 14 to the atmosphere. When the purge valve 26 is closed, compressed air may flow to the air motor 14 without being diverted through the purge valve 26. As described further below, the purge valve 26 may be used to relieve excess pressure from the pump system 10, allowing the piston pump 12 to quickly stop pumping.

The pump system 10 further includes a linear encoder 28 coupled to the piston pump 12. The linear encoder 28 is an electronic sensor configured to generate an electrical signal indicative of the position of the plunger 16. The electrical signal additionally may indicate the direction of travel of the plunger 16, that is, whether the plunger 16 is on the downstroke or the upstroke. The linear encoder 28 may be embodied as a vernier type encoder with a two-channel quadrature output. The linear encoder 28 may be physically attached to the piston pump 12, for example, to a rod connecting the air motor 14 and the plunger 16. In some embodiments, the linear encoder 28 may determine the position of the plunger 16 by optically sensing lines, patterns, or other visual indicia positioned on the plunger 16 or the connecting rod. In other embodiments, the linear encoder 28 may determine the position of the plunger 16 by electromagnetically sensing materials of differing magnetic properties that are positioned on (or incorporated in) the plunger 16 or the connecting rod.

The pump system 10 also includes a pressure sensor 30 coupled to the media outlet 20 of the piston pump 12. The pressure sensor 30 generates an electrical signal indicative of pressure of the fluid media at the media outlet 20. For example, the pressure sensor 30 may produce an analog signal between zero and ten volts that is proportional to the pressure measured at the media outlet 20.

The pump system 10 further includes an electronic controller 32 that is electrically connected to the metering valve 22, the purge valve 26, the linear encoder 28, and the pressure sensor 30. The controller 32 may be embodied as a discrete component connected via various electronic inputs and outputs to the other components of the pump system 10. In other embodiments, the controller 32 may be physically incorporated or integrated with other components of the pump system 10, for example, with the piston pump 12. The controller 32 may be sealed or hardened for use in an industrial plant. The controller 32 is, in essence, the master computer responsible for interpreting signals sent by sensors associated with the pump system 10 and for activating or energizing electronically-controlled components associated with the pump system 10. For example, the controller 32 is configured to monitor various signals from the linear encoder 28 and the pressure sensor 30, to control operation of the metering valve 22 and the purge valve 26, and to determine when various operations of the pump system 10 should be performed, among many other things. In particular, as will be described in more detail below with reference to FIGS. 3-7, the controller 32 is operable to control metering and dispense operations of the pump system 10.

To do so, the controller 32 includes a number of electronic components commonly associated with electronic control units utilized in the control of electromechanical systems. In the illustrative embodiment, the controller 32 of the pump system 10 includes a processor 34, an input/output ("I/O") subsystem 36, a memory 38, and a user interface 40. It will be appreciated that the controller 32 may include other or additional components, such as those commonly found in a computing device (e.g., various input/output devices). Additionally, in some embodiments, one or more of the illustrative components of the controller 32 may be incorporated in, or otherwise form a portion of, another component of the controller 32 (e.g., as with a microcontroller).

The processor 34 of the controller 32 may be embodied as any type of processor capable of performing the functions described herein. For example, the processor may be embodied as one or more single or multi-core processors, digital signal processors, microcontrollers, or other processors or processing/controlling circuits. Similarly, the memory 38 may be embodied as any type of volatile or non-volatile memory or data storage device capable of performing the functions described herein. The memory 38 stores various data and software used during operation of the controller 32, such as operating systems, applications, programs, libraries, and drivers. For instance, the memory 38 may store instructions in the form of a software routine (or routines) which, when executed by the processor 34, allows the controller 32 to control operation of the pump system 10. The user interface 40 permits a user to interact with the controller 32 to, for example, initiate a dispense operation, specify a desired batch volume, flow rate, or pressure, or configure the pump system 10 for particular applications. As such, in some embodiments, the user interface 40 includes a keypad, touch screen, display, and/or other mechanisms to permit I/O functionality.

The memory 38 and the user interface 40 are communicatively coupled to the processor 34 via the I/O subsystem 36, which may be embodied as circuitry and/or components to facilitate I/O operations of the controller 32. For example, the I/O subsystem 36 may be embodied as, or otherwise include, memory controller hubs, I/O control hubs, firmware devices, communication links (e.g., point-to-point links, bus links, wires, cables, light guides, printed circuit board traces, etc.), and/or other components and subsystems to facilitate the I/O operations. In the illustrative embodiment, the I/O subsystem 36 includes an analog-to-digital ("A/D") converter, or the like, that converts analog signals from the linear encoder 28 or the pressure sensor 30 into digital signals for use by the processor 34. It should be appreciated that, if any one or more of the sensors associated with the pump system 10 generate a digital output signal, the A/D converter may be bypassed. Similarly, in the illustrative embodiment, the I/O subsystem 36 includes a digital-to-analog ("D/A") converter, or the like, that converts digital signals from the processor 34 into analog signals for use by the metering valve 22 and/or the purge valve 26. It should also be appreciated that, if the metering valve 22 or the purge valve 26 operates using a digital input signal, the D/A converter may be bypassed.

Figure 2:
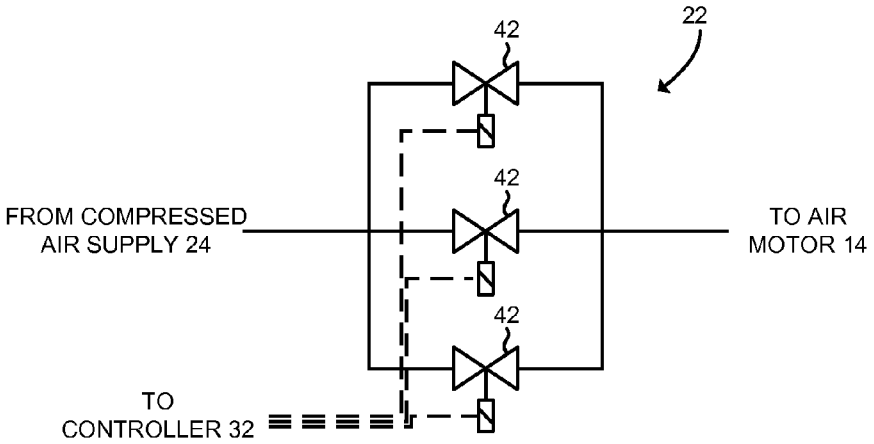
FIG. 2 is a simplified block diagram of at least one embodiment of a metering valve network that may be used with the control system of FIG. 1.

Referring now to FIG. 2, one illustrative embodiment of the metering valve 22 is shown as a simplified block diagram. The illustrated metering valve 22 includes three solenoid valves 42 arranged in a parallel fluid network. Each of the solenoid valves 42 is communicatively connected to the controller 32. The solenoid valves 42 may have the same flow capacity when open, or may have different flow capacities. In one embodiment, each solenoid valve 42 has twice the flow capacity of the previous solenoid valve 42. Thus, the controller 32 may control the total flow through the metering valve 22 by selectively opening or closing each of the solenoid valves 42 (such that none, all, or a subset of the solenoid valves 42 are open at the same time). In the illustrative embodiment, given the three solenoid valves 42 (each having twice the flow capacity of the previous solenoid valve 42), eight different flow rates may be achievable. Other embodiments may user fewer or additional solenoid valves 42, with additional solenoid valves 42 allowing for increased adjustability. An array of solenoid valves 42 as shown in FIG. 2 may be less expensive than an equivalent variable flow valve, such as a needle valve.

Figure 3:
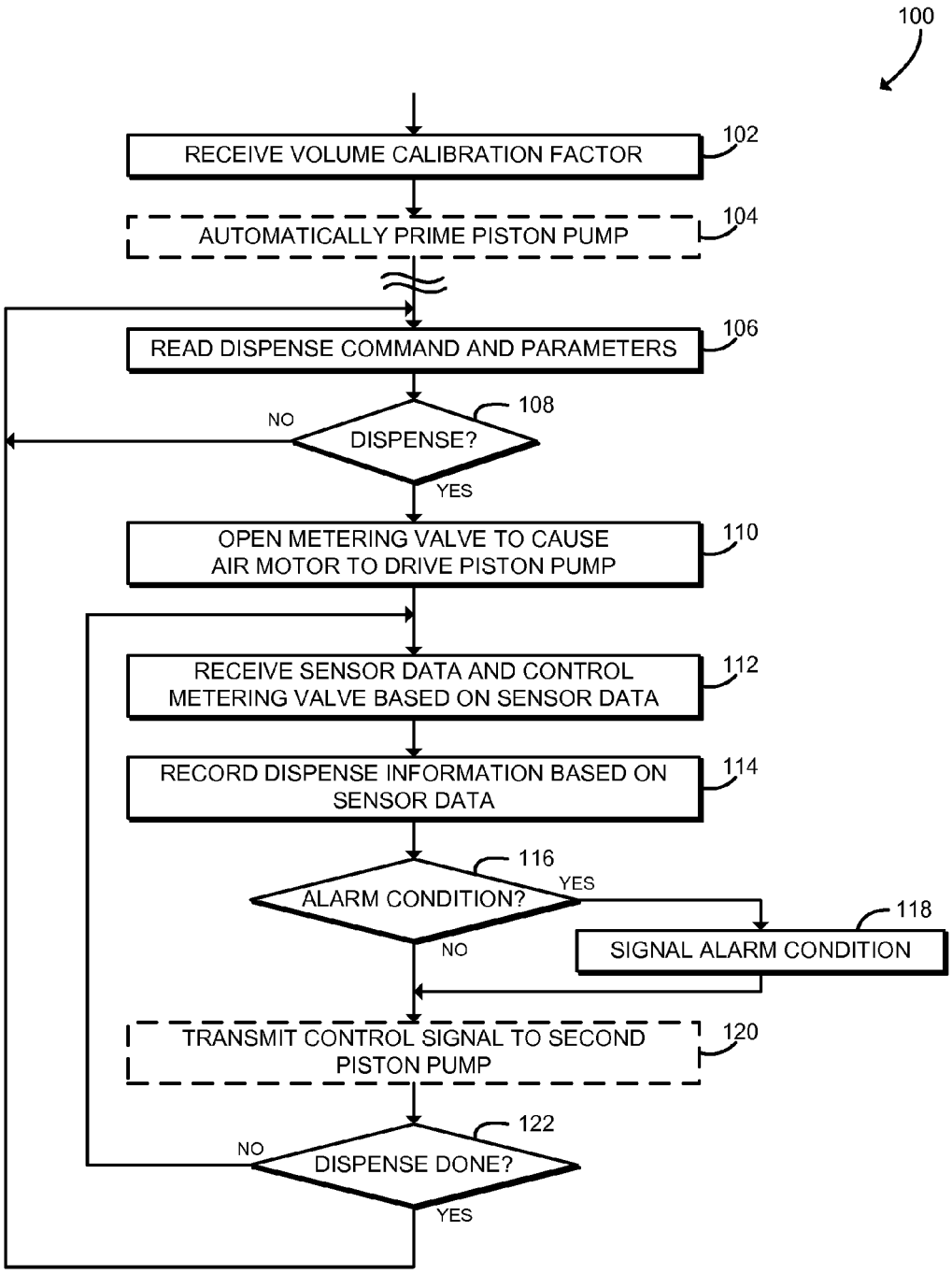
FIG. 3 is a simplified flow diagram of at least one embodiment of a method for metering and dispense control using the system of FIG. 1.

Referring now to FIG. 3, one illustrative embodiment of a method 100 for metering and dispense control using the pump system 10 is shown as a simplified flow diagram. The method 100 is illustrated as a number of blocks 102-122, which may be performed by various components of the pump system 10. The method 100 begins in block 102, in which the controller 32 receives a volume calibration factor. The volume calibration factor is a numerical quantity that may be used to convert between linear motion of the plunger 16 and volume of fluid media that is pumped. As a simple example, given a cylindrical pumping chamber, the volume calibration factor may be the area of the plunger 16. The volume calibration factor may be supplied by a supplier and/or user of the pump system 10 during the initial installation or configuration of the pump system 10, for example using the user interface 40 of the controller 32.

Some embodiments of the method 100 may optionally employ block 104, in which the controller 32 automatically primes the piston pump 12. When the piston pump 12 is initially connected or reconnected to a fluid source, it must be primed to remove air and ready the piston pump 12 for immediate dispensing of fluid. Thus, block 104 may be employed on initial setup or when a fluid source is disconnected and then reconnected. Additionally, in some embodiments automatic priming may be performed upon receiving a separate command from a user, for example through the user interface 40. One embodiment of a method for automatically priming the piston pump 12 is described below in connection with FIG. 7.

After some time, in block 106, the controller 32 reads a dispense command and any associated parameters. In some embodiments, the dispense command may be entered by a user using the user interface 40 of the controller 32. The associated parameters may include the desired batch volume, the desired volumetric flow rate, or the desired media outlet pressure. In other embodiments, the dispense command may be received by the controller 32 from another component in an industrial process. For example, the pump system 10 may be coupled to a robotic dispense head. When the dispense head is placed into an appropriate position, an external control system may signal the controller 32 to dispense a batch. In still other embodiments, the dispense command may be received from another pump system 10. As described further below, two or more pump systems 10 may be coupled in a master/follower relationship, and the follower pump system 10 may dispense when directed by the master pump system 10. Such master/follower systems may be used, for example, for volumetric ratio mixing of several fluids. In block 108, the controller 32 determines whether to dispense fluid. If not, the method 100 loops back to block 106 to continue monitoring for dispense commands. If so, the method 100 advances to block 110.

In block 110, the controller 32 opens the metering valve 22 to allow compressed air to flow into the air motor 14 and thereby initiate pumping with the piston pump 12. As described above, to open the metering valve 22, the controller 32 may transmit an electronic control signal to the metering valve 22 (or to various components of the metering valve 22, such as the solenoid valves 42). The controller 32 may transmit a digital signal, an analog signal, an encoded collection of digital signals, or any other control signal that directs the metering valve 22 to open and allow flow of compressed air.

In block 112, the controller 32 receives sensor data from the linear encoder 28 and/or the pressure sensor 30 and controls the metering valve 22 based on the sensor data. The controller 32 may control the metering valve by modifying the control signals sent to the metering valve 22 or its components. As described further below connection with FIGS. 3-6, the controller 32 may measure and control the pump system 10 to produce a measured batch of a particular volume of fluid, a continuous stream of fluid at a target volumetric flow rate, or a continuous stream of fluid at a target outlet pressure.

In block 114, the controller 32 may record metering and dispense data based on the received sensor data. For example, the controller 32 may record dispensed volume, number of batches dispensed, volumetric flow rate, outlet pressure, or any other data measured or calculated during dispense of the fluid media. The controller 32 may record the data using an electronic data storage device such as the memory 38 (or another memory device), an electromechanical device such as a printer or chart recorder, or any other device capable of recording information.

In block 116, the controller 32 determines whether an alarm condition exists based on the sensor data. An alarm condition includes any exceptional condition of the pump system 10 that should be communicated to a user. For example, the alarm condition may include a failure of the automatic priming process, a low outlet pressure condition, a high outlet pressure condition, or when a cycle count limit has been exceeded by the piston pump 12. If no alarm condition exists, the method 100 advances to block 120, described below. If an alarm condition exists, the method 100 branches to block 118. In block 118, the controller 32 signals the alarm condition. The controller 32 may signal the alarm condition using the user interface 40, for example by activating indicator lights, displaying an alert on a display screen, or sounding an audible alarm via a speaker. In some embodiments, the controller 32 may signal the alarm condition by transmitting a signal to an external control device, for example to an external controller for an industrial process. For emergency or safety-related alarm conditions, the controller 32 may activate an emergency shutdown or failsafe routine (not illustrated). After signaling the alarm condition, the method 100 advances to block 120.

Some embodiments of the method 100 may optionally employ block 120, in which the controller 32 transmits a control signal to a second pump system 10. The control signal may be indicative of a measured quantity of the fluid media, and may cause the second pump system 10 to dispense a particular amount of fluid. For example, the control signal may indicate the dispensed volume of the fluid, and may cause the second pump system 10 to dispense a proportional amount of fluid. As another example, the control signal may indicate the volumetric flow rate or pressure of the fluid, and may cause the second pump system 10 to dispense fluid at a proportional volumetric flow rate or pressure. This control signal may be used by the master pump system 10 in a master/follower system to control a follower pump system 10. Such master/follower systems may be used to dispense multiple fluids at predefined mixing ratios (e.g., the components of an epoxy adhesive).

In block 122, the controller 32 determines whether the dispense operation is complete. The dispense operation may be completed for numerous reasons, including when the controller 32 has determined that a batch volume has been dispensed, when a command has been received from the user to stop dispensing, when an alarm condition has been detected, or when a command to stop dispensing has been received from another device, such as a second pump system 10 or an external controller. If the controller 32 determines that the dispense operation is not complete, the method 100 loops back to block 112, to continue receiving sensor data and controlling the metering valve 22 during the dispense operation. If the controller 32 determines that the dispense operation is complete, the method 100 loops back to block 104 to await further dispense commands.

Figure 4:
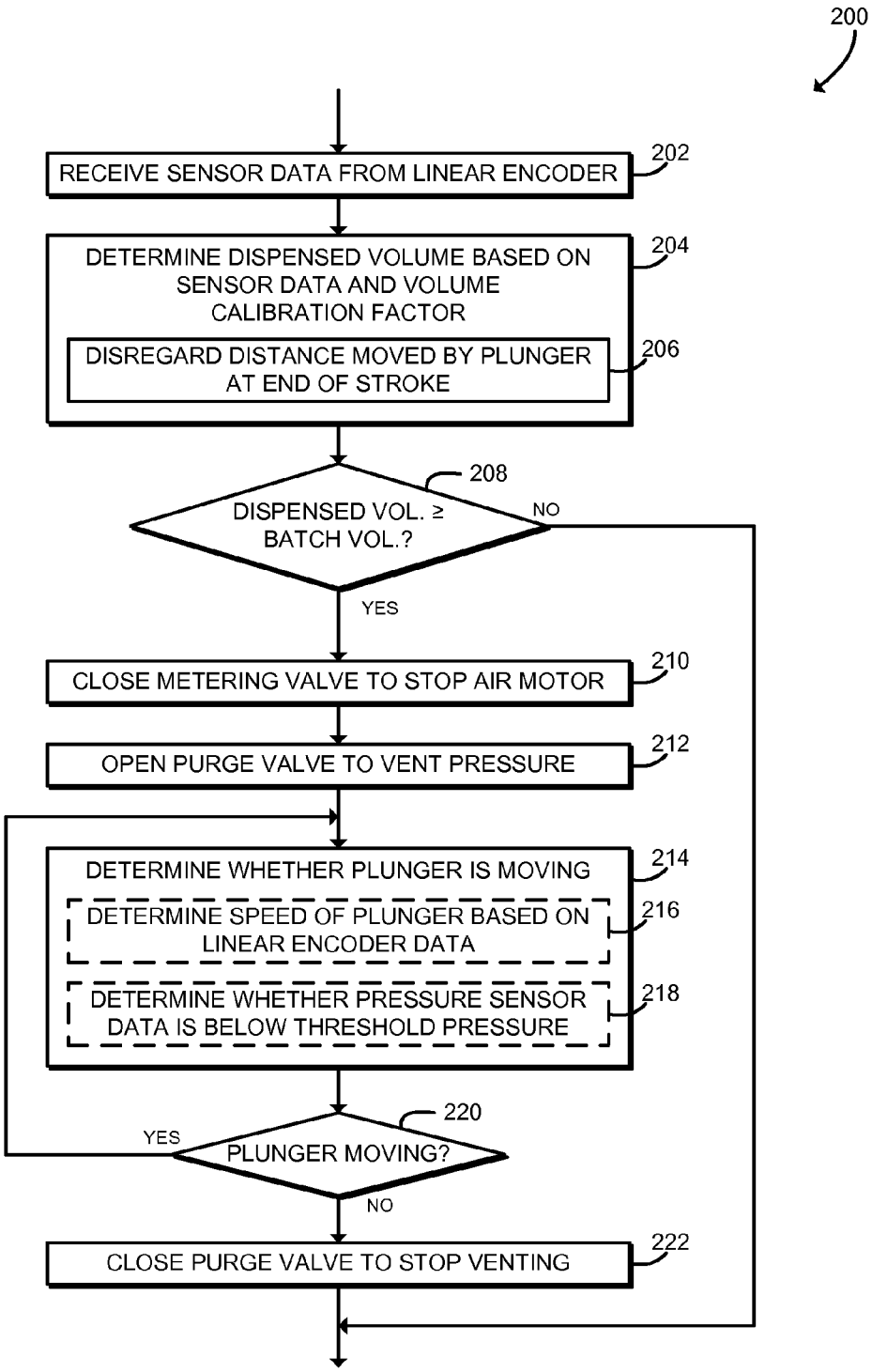
FIG. 4 is a simplified flow diagram of at least one embodiment of a method for batch metering and dispense control using the system of FIG. 1.

Referring now to FIG. 4, one illustrative embodiment of a method 200 for batch metering and dispense control using the pump system 10 is shown as a simplified flow diagram. The method 200 may be used as one illustrative embodiment of the sensor monitoring and control function in block 112 of method 100 (see FIG. 3). The method 200 is illustrated as a number of blocks 202-222, which may be performed by various components of the pump system 10. The method 200 begins in block 202 in which the controller 32 receives sensor data from the linear encoder 28. As described above, the sensor data represents the position of the plunger 16 of the piston pump 12, and may also indicate the direction of the plunger 16.

In block 204, the controller 32 determines the dispensed volume of the fluid media as a function of the sensor data and the volume calibration factor. The sensor data is used to determine the distance traveled by the plunger 16 during the dispense operation. The plunger 16 may complete several strokes while dispensing a single batch. To accommodate multiple pumping cycles, the controller 32 determines the total distance traveled by the plunger 16 while pumping fluid. For example, for a single-acting pump, the controller 32 may determine total distance traveled during one pumping stroke of each cycle, and, for a double-acting pump, the controller 32 may determine total distance traveled. As described above, this distance may be multiplied by the volume calibration factor to determine the volume of the fluid media that has been dispensed. As used in the present disclosure, the language "as a function of" and "based on" is intended to be open-ended, such that the subject determination may be a function of or based on not only the factors expressly listed but also additional factors.

As part of calculating the dispensed volume in block 206, the controller 32 may disregard any distance moved by the plunger 16 at the end of the stroke, where no fluid is pumped. When the end of a stroke is reached, the plunger 16 stops moving, and the pressure of the fluid media may drop. This reduced pressure may cause the fluid to stop pumping until the plunger 16 has reversed direction and moved some distance to increase the pressure. To disregard the distance moved without pumping fluid, the controller 32 may determine when the plunger 16 reaches an end-of-stroke position (either at the end of the upstroke or of the downstroke) and disregard any motion of the plunger 16 until the plunger 16 reaches a pump-start position, where the piston pump 12 resumes pumping fluid. The pump-start position may be a predefined position of the plunger 16 where it is known that the piston pump 12 resumes pumping, and the controller 32 may monitor sensor data from the linear encoder 28 to determine when the plunger 16 reaches the pump-start position. Additionally or alternatively, in some embodiments the controller 32 may determine the pump-start position based on data received from the pressure sensor 30. The pump-start position may be determined to be the position where the outlet pressure measured by the pressure sensor 30 at the media outlet 20 meets or exceeds a predetermined pressure.

In block 208, the controller 32 determines whether the dispensed volume meets or exceeds the predetermined batch volume. As described above, the predetermined batch volume may be input by a user to the controller 32 using the user interface 40, or may be received from another device such as a second pump system 10. If the dispensed volume does not meet or exceed the predetermined batch volume, this cycle of method 200 is complete. As described above in connection with FIG. 3, during a batch dispense operation, the method 200 may be executed numerous times to allow for continuous or periodic monitoring of sensor data and control of the metering valve 22. If the dispensed volume meets or exceeds the predetermined batch volume in block 208, the method 200 advances to block 210.

In block 210, the controller 32 closes the metering valve 22, blocking the flow of compressed air to the air motor 14. As described above, to operate the metering valve 22, the controller 32 outputs one or more electronic control signals that cause the metering valve 22 to open or close as directed. For example, the controller 32 may transmit a digital off signal or an analog zero-flow signal to close the metering valve 22. Closing the metering valve 22 prevents compressed air from flowing to the air motor 14, stopping the motion of the plunger 16.

In block 212, the controller 32 opens the purge valve 26, allowing compressed air to vent from the air motor 14. As described above, to operate the purge valve 26, the controller 32 outputs one or more electronic control signals that cause the purge valve 26 to open or close as directed. For example, the controller 32 may transmit a digital on signal to open the purge valve 26. Without venting compressed air, residual pressure in the air motor 14 may continue to drive the plunger 16, which in turn may reduce metering accuracy. Opening the purge valve 26 releases any residual pressure from the air motor 14 after the metering valve 22 is closed, allowing the air motor 14 and the plunger 16 to quickly come to a stop.

In block 214, the controller 32 determines whether the plunger 16 is still moving. As described above, due to inertia and residual pressure, shutting off compressed air to the air motor 14 may not immediately stop the piston pump 12. The controller 32 may use any appropriate method to determine whether the plunger 16 is moving. Some embodiments of the method 200 may optionally employ block 216, in which the controller 32 determines the speed of the plunger 16 based on data from the linear encoder 28. When the data from the linear encoder 28 stops changing, the speed of the plunger 16 is zero and thus the plunger 16 has stopped moving. Additionally or alternatively, some embodiments of the method 200 may optionally employ block 218, in which the controller 32 determines whether outlet pressure of the fluid media is below a threshold value, based on sensor data received from the pressure sensor 30. In block 220, the controller 32 evaluates whether the plunger 16 is moving. If the plunger 16 is moving, the method 200 loops back to block 214 to continue monitoring the motion of the plunger 16 while the metering valve 22 is closed and the purge valve 26 is open. If the plunger 16 is not moving, the method 200 advances to block 222.

In block 222, the controller 32 closes the purge valve 26. As described above, the controller 32 transmits an electronic control signal to the purge valve 26 that causes the purge valve 26 to close. After closing the purge valve 26, any remaining residual air pressure of the air motor 14 is retained, which may improve restart performance. If the purge valve 26 were to remain open for an extended period of time, the air pressure of the pump system 10 would equalize to ambient pressure. To restart such a pump system 10 would require supplying sufficient compressed air to fully pressurize the air motor 14. In contrast, closing the purge valve 26 after the plunger 16 stops moving allows the pump system 10 to retain some pressure above ambient, and thus may require less compressed air to restart the air motor 14. The retained pressure may be only slightly below the pressure required to move the plunger 16, meaning that the piston pump 12 may be restarted relatively quickly. After closing the purge valve 26, the method 200 is completed. As described above with respect to FIG. 3, after the dispensing the predetermined batch volume of fluid, the pump system 10 may await further dispense commands.

Figure 5:
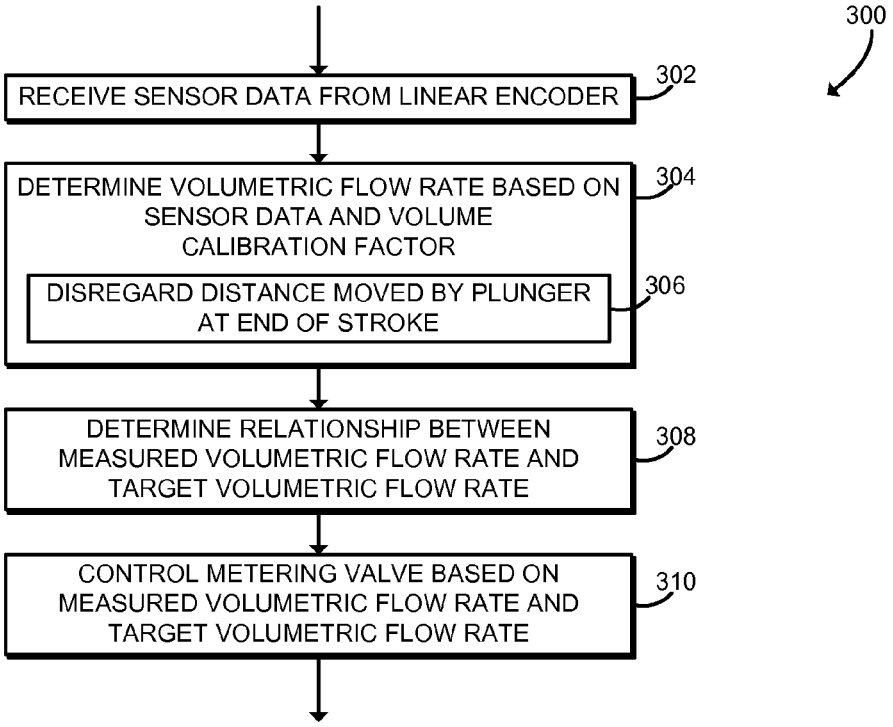
FIG. 5 is a simplified flow diagram of at least one embodiment of a method for continuous flow metering and dispense control using the system of FIG. 1.

Referring now to FIG. 5, one illustrative embodiment of a method 300 for continuous flow rate metering and dispense control using the pump system 10 is shown as a simplified flow diagram. The method 300 may be an embodiment of the sensor monitoring and control function of block 112 of FIG. 3, described above. The method 300 is illustrated as a number of blocks 302-310, which may be performed by various components of the pump system 10. The method 300 begins in block 302 in which the controller 32 receives sensor data from the linear encoder 28. As described above, the sensor data represents the position of the plunger 16 of the piston pump 12, and may also indicate the direction of the plunger 16.

In block 304, the controller 32 determines the volumetric flow rate of the fluid media as a function of the sensor data and the volume calibration factor. The sensor data is used to determine the distance traveled by the plunger 16 during the dispense operation. The plunger 16 may complete several strokes while performing the dispense operation. The controller 32 determines the distance traveled for each pumping stroke. To accommodate multiple pumping cycles, the controller 32 determines the total distance traveled by the plunger 16 while pumping fluid. For example, for a single-acting pump, the controller 32 may determine total distance traveled during one pumping stroke of each cycle, and, for a double-acting pump, the controller 32 may determine total distance traveled. As described above, this distance may be multiplied by the volume calibration factor to determine the volume of the fluid media that has been dispensed, and the volumetric flow rate may be further determined as a function of the dispensed volume and the elapsed time of the dispense operation.

As part of calculating the volumetric flow rate in block 306, the controller 32 may disregard any distance moved by the plunger 16 at the end of the stroke, where no fluid is pumped. As described above with respect to block 206 of FIG. 4, when the end of a stroke is reached, the plunger 16 stops moving, and the pressure of the fluid media may drop. This reduced pressure may cause the fluid to stop pumping until the plunger 16 has reversed direction and moved some distance to increase the pressure. To disregard the distance moved without pumping fluid, the controller 32 may determine when the plunger 16 reaches an end-of-stroke position (either at the end of the upstroke or of the downstroke) and disregard any motion of the plunger 16 until the plunger 16 reaches a pump-start position, where the piston pump 12 resumes pumping fluid. The pump-start position may be a predefined position of the plunger 16 where it is known that the piston pump 12 resumes pumping, and the controller 32 may monitor sensor data from the linear encoder 28 to determine when the plunger 16 reaches the pump-start position. Additionally or alternatively, in some embodiments the controller 32 may determine the pump-start position based on data received from the pressure sensor 30. The pump-start position may be determined to be the position where the outlet pressure measured by the pressure sensor 30 at the media outlet 20 exceeds a predetermined pressure.

In block 308, the controller 32 determines a relationship between the measured volumetric flow rate and a target flow rate. As described above, the target flow rate may be input by the user using the user interface 40, or may be derived from a control signal received from another device, such as a second pump system 10 or an external controller. The controller 32 may determine whether the measured flow rate is greater than, equal to, or less than the target flow rate. In some embodiments, the controller 32 may determine an error signal based on the measured flow rate and the target flow rate.

In block 310, the controller 32 controls the metering valve 22 based on the relationship between the measured flow rate and the target flow rate. As described above, the controller 32 may transmit an electronic control signal to the metering valve 22 that causes the metering valve 22 to open, close, or achieve a set flow rate. The controller 32 may modify an existing control signal to the metering valve 22 based on the determined relationship between the measured flow rate and the target flow rate. The controller 32 may determine the appropriate control setting for the metering valve 22 using any known control algorithm. For example, the controller 32 may implement an open-loop control algorithm, a proportional-integral controller, a proportional-integral-derivative controller, or a fuzzy logic control algorithm. In some embodiments, the controller 32 may send control signals to selectively activate individual solenoid valves 42 of the metering valve 22. After modifying the control signal to cause the metering valve 22 to assume the correct setting, the method 300 is completed. As described above in connection with FIG. 3, during continuous flow metering, the method 300 may be executed numerous times to allow for continued monitoring of sensor data and control of the metering valve 22.

Figure 6:
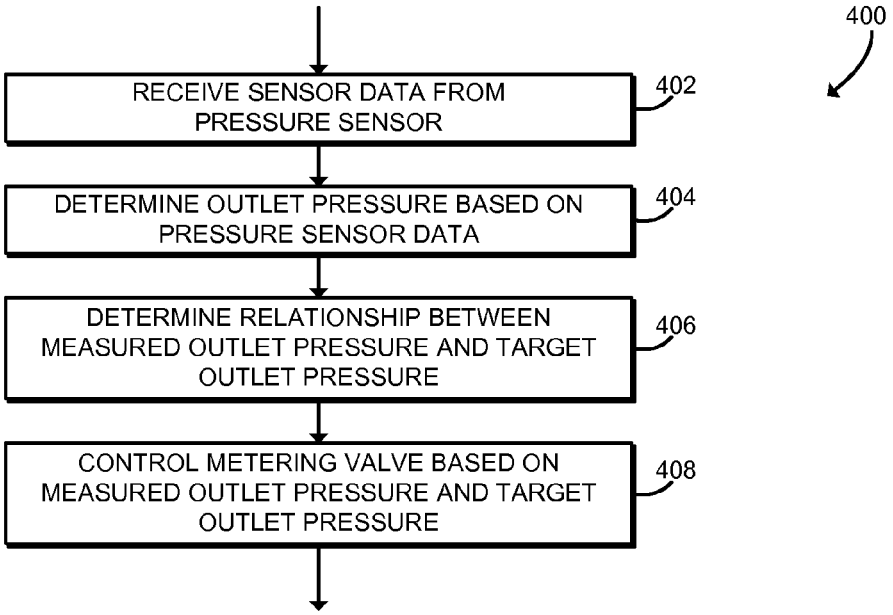
FIG. 6 is a simplified flow diagram of at least one embodiment of a method for pressure metering and dispense control using the system of FIG. 1.

Referring now to FIG. 6, one illustrative embodiment of a method 400 for pressure metering and dispense control using the pump system 10 is shown as a simplified flow diagram. The method 400 may be an embodiment of the sensor monitoring and control function of block 112 of FIG.

3, described above. The method 400 is illustrated as a number of blocks 402-408, which may be performed by various components of the pump system 10. The method 400 begins in block 402, in which the controller 32 receives sensor data from the pressure sensor 30. As described above, the sensor data indicates outlet pressure of the fluid media at the media outlet 20. In block 404, the controller 32 determines outlet pressure based on the sensor data. In some embodiments, the controller 32 may determine the outlet pressure by applying an appropriate conversion factor to the analog or digital signal received from the pressure sensor 30.

In block 406, the controller 32 determines a relationship between the measured outlet pressure and a target outlet pressure. As described above, the target outlet pressure may be input by a user using the user interface 40, or may be derived from a control signal received from another device, such as a second pump system 10 or an external controller. The controller 32 may determine whether the measured outlet pressure is greater than, equal to, or less than the target outlet pressure. The controller 32 may average, smooth, or otherwise filter the measured outlet pressure to account for ordinary pulsations produced by the piston pump 12. In some embodiments, the controller 32 may determine an error signal based on the measured outlet pressure and the target outlet pressure.

In block 408, the controller 32 controls the metering valve 22 based on the relationship between the measured outlet pressure and the target outlet pressure. The controller 32 may transmit an electronic control signal to the metering valve 22 that causes the metering valve 22 to open, close, or achieve a set flow rate. The controller 32 may modify an existing control signal to the metering valve 22 based on the determined relationship between the measured outlet pressure and the target outlet pressure. The controller 32 may determine the appropriate control setting for the metering valve 22 using any known control algorithm. For example, the controller 32 may implement an open-loop control algorithm, a proportional-integral controller, a proportional-integral-derivative controller, or a fuzzy logic control algorithm. In some embodiments, the controller 32 may selectively activate individual solenoid valves 42 of the metering valve 22. After causing the metering valve 22 to assume the correct setting, the method 400 is completed. As described above in connection with FIG. 3, during continuous pressure metering, the method 400 may be executed numerous times to allow for continued monitoring of sensor data and control of the metering valve 22.

Figure 7:
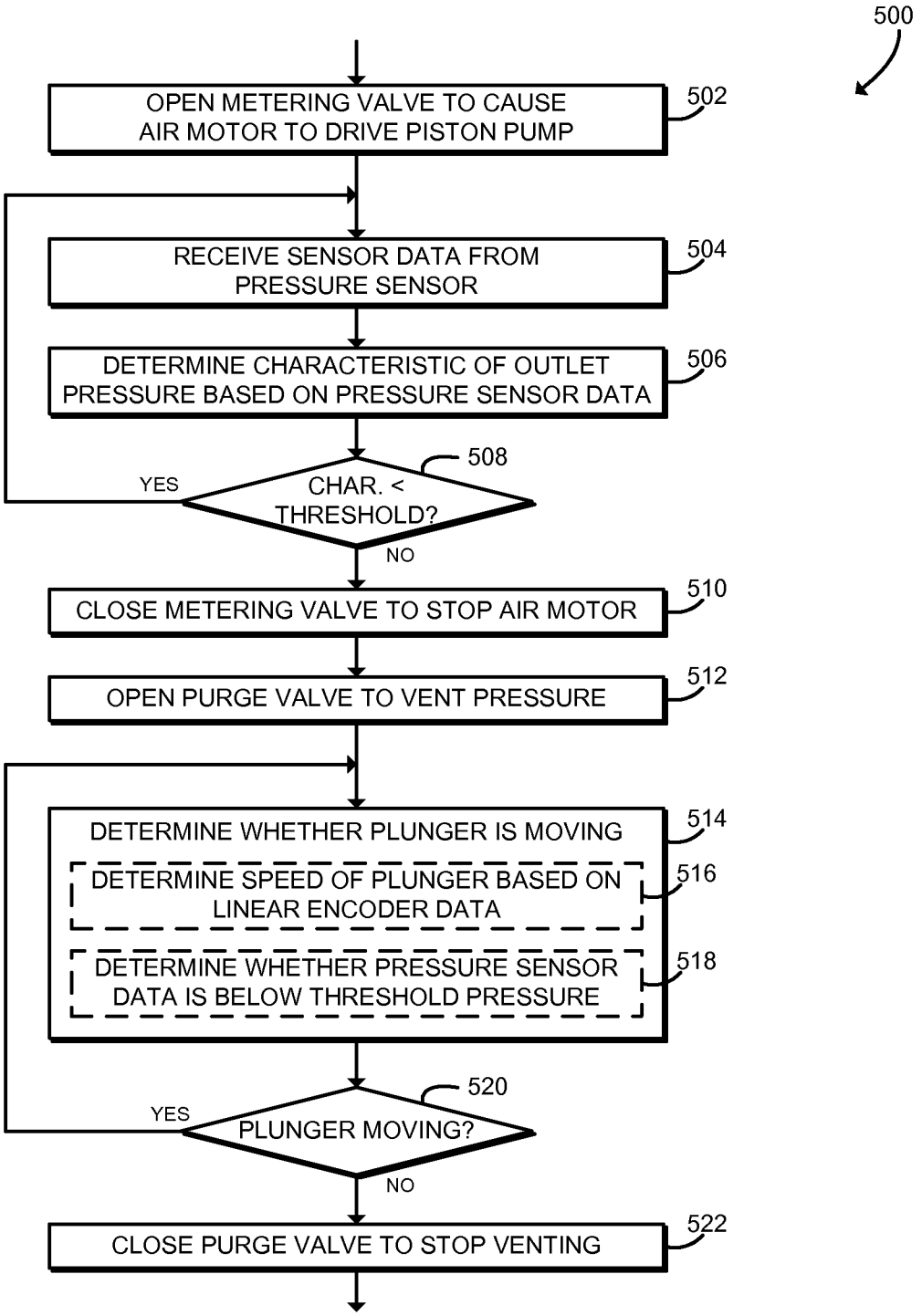
FIG. 7 is a simplified flow diagram of at least one embodiment of a method for automatic priming using the system of FIG. 1.

Referring now to FIG. 7, one illustrative embodiment of a method 500 for automatic priming using the pump system 10 is shown as a simplified flow diagram. The method 500 may be an embodiment of the pump priming function of block 104 of FIG. 3, described above. The method 500 is illustrated as a number of blocks 502-522, which may be performed by the various components of the pump system 10. The method 500 begins in block 502, in which the controller 32 opens the metering valve 22 to allow compressed air to flow into the air motor 14 and thereby initiate pumping with the piston pump 12. As described above, to open the metering valve 22, the controller 32 may transmit an electronic control signal to the metering valve 22 or components of the metering valve 22. The controller 32 may transmit a digital signal, an analog signal, an encoded collection of digital signals, or any other control signal that directs the metering valve 22 to open and allow flow.

In block 504, the controller 32 receives sensor data from the pressure sensor 30. As described above, the sensor data indicates outlet pressure of the fluid media at the media outlet 20. In block 506, the controller 32 determines a characteristic of the outlet pressure of the fluid media at the media outlet 20, using the pressure sensor 30 data. The characteristic may include a differential (i.e., rate of change) of the pressure signal, an average of the pressure signal, a rolling average of the pressure signal, a peak value of the pressure signal, and/or an amplitude of the pressure signal. The characteristic measured during priming, that is, while the piston pump 12 is pumping air and not fluid, is significantly different from that measured once the piston pump 12 is primed. It is contemplated that any number of pressure signal characteristics may be used in block 506, so the illustrative characteristics listed above should not be regarded as limiting.

In block 508, the controller 32 determines whether the measured characteristic of the outlet pressure is less than a threshold. The threshold is a predefined value that represents a characteristic of the outlet pressure when the piston pump 12 is primed. Thus, if the characteristic is less than the threshold, then the piston pump 12 is not primed, and the method 500 loops back to block 504 to continue priming the piston pump 12. If the characteristic is greater than or equal to the threshold, the piston pump 12 is primed and the method 500 advances to block 510.

After priming the piston pump 12, the controller 32 stops the piston pump 12 (in a similar manner to that described above in connection with FIG. 4). In block 510, the controller 32 closes the metering valve 22, blocking the flow of compressed air to the air motor 14. As described above, to operate the metering valve 22, the controller 32 outputs one or more electronic control signals that cause the metering valve 22 to open or close as directed. For example, the controller 32 may transmit a digital off signal or an analog zero-flow signal to close the metering valve 22. Closing the metering valve 22 prevents compressed air from flowing to the air motor 14, stopping the motion of the plunger 16.

In block 512, the controller opens the purge valve 26, allowing compressed air to vent from the air motor 14. As described above, to operate the purge valve 26, the controller 32 outputs one or more electronic control signals that cause the purge valve 26 to open or close as directed. For example, the controller 32 may transmit a digital on signal to open the purge valve 26. Without venting compressed air, residual pressure in the air motor 14 may continue to drive the plunger 16, which in turn may reduce metering accuracy. Opening the purge valve 26 releases any residual pressure from the air motor 14 after the metering valve 22 is closed, allowing the air motor 14 and the plunger 16 to quickly come to a stop.

In block 514, the controller 32 determines whether the plunger 16 is moving. As described above, due to inertia and residual pressure, shutting off compressed air to the air motor 14 does not immediately stop the piston pump 12. The controller 32 may use any appropriate method to determine whether the plunger 16 is moving. Some embodiments of the method 500 may optionally employ block 516, in which the controller 32 determines the speed of the plunger 16 based on data from the linear encoder 28. When the data from the linear encoder 28 stops changing, the speed of the plunger 16 is zero and thus the plunger 16 has stopped moving. Additionally or alternatively, some embodiments of the method 500 may optionally employ block 518, in which the controller 32 determines whether outlet pressure of the fluid media is below a threshold value, based on sensor data received from the pressure sensor 30. In block 520, the controller 32 evaluates whether the plunger 16 is moving. If the plunger 16 is moving, the method 500 loops back to block 514 to continue monitoring the motion of the plunger 16 while the metering valve 22 is closed and the purge valve 26 is open. If the plunger 16 is not moving, the method 500 advances to block 522.

In block 522, the controller 32 closes the purge valve 26. As described above, the controller 32 transmits an electronic control signal to the purge valve 26 that causes the purge valve 26 to close. After closing the purge valve 26, any remaining residual air pressure of the air motor 14 is retained, which may improve restart performance. If the purge valve 26 were to remain open for an extended period of time, the air pressure of the pump system 10 would equalize to ambient pressure. To restart such a pump system 10 would require supplying sufficient compressed air to fully pressurize the air motor 14. In contrast, closing the purge valve 26 after the plunger 16 stops moving allows the pump system 10 to retain some pressure above ambient, and thus may require less compressed air to restart the air motor 14. The retained pressure may be only slightly below the pressure required to move the plunger 16, which means that the piston pump 12 may be restarted relatively quickly. After closing the purge valve 26, the method 500 is completed. As described above with respect to FIG. 3, after automatically priming the piston pump 12, the pump system 10 may await dispense commands. In some embodiments (not shown), the pump system 10 may automatically prime the piston pump 12 at other times or when necessary, for example after receiving a dispense command.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. Apparatus comprising:

a piston pump including a motor and a plunger, wherein the motor is configured to drive linear reciprocating motion of the plunger in response to being supplied with a flow of compressed fluid;

a metering valve fluidly coupled to the motor, the metering valve being configured to control the flow of compressed fluid to the motor;

a purge valve fluidly coupled between the metering valve and the motor;

a linear encoder coupled to the piston pump, the linear encoder configured to generate sensor data indicative of a position of the plunger;

an electronic controller operatively coupled to the metering valve, the purge valve, and the linear encoder, wherein the electronic controller is configured to receive sensor data from the linear encoder and to control the metering valve and the purge valve; and a pressure sensor fluidly coupled to an outlet of the piston pump and operatively coupled to the electronic controller, the pressure sensor configured to generate pressure data indicative of a pressure of the fluid media pumped by the piston pump, wherein the electronic controller is configured to determine that the linear reciprocating motion of the plunger has stopped when the pressure data indicates that the pressure of the fluid media has reached a threshold value.

2. The apparatus of claim 1, wherein the electronic controller is configured to:

transmit a first control signal to cause the metering valve to permit the flow of compressed fluid to the motor;

determine a dispensed volume of a fluid media pumped by the piston pump as a function of the sensor data and a volume-distance calibration factor;

modify the first control signal, in response to determining that the dispensed volume is equal to or greater than a target volume, to cause the metering valve to block the flow of compressed fluid to the motor; and transmit a second control signal, in response to determining that the dispensed volume is equal to or greater than a target volume, to cause the purge valve to vent compressed fluid from the motor.

3. The apparatus of claim 2, wherein the electronic controller is further configured to modify the second control signal, in response to determining that the linear reciprocating motion of the plunger has stopped, to cause the purge valve to cease venting compressed fluid from the motor.

4. The apparatus of claim 2, wherein the electronic controller is configured to determine the dispensed volume, in part, by disregarding a distance moved by the plunger between its end-of-stroke position and its pump-start position.

5. The apparatus of claim 1, wherein the electronic controller is further configured to:

transmit a control signal to cause the metering valve to permit the flow of compressed fluid to the motor;

determine a volumetric flow rate of a fluid media pumped by the piston pump as a function of the sensor data and a volume-distance calibration factor; and modify the control signal as a function of the determined volumetric flow rate and a target volumetric flow rate.

6. The apparatus of claim 5, wherein the electronic controller is configured to determine the volumetric flow rate, in part, by disregarding a distance moved by the plunger between its end-of-stroke position and its pump-start position.

7. The apparatus of claim 1, wherein the electronic controller is configured to:

transmit a first control signal to cause the metering valve to permit the flow of compressed fluid to the motor;

determine the pressure of the fluid media pumped by the piston pump using the pressure data received from the pressure sensor; and modify the first control signal as a function of the determined pressure and a target pressure.

8. The apparatus of claim 7, wherein the electronic controller is further configured to:

modify the first control signal, in response to the determined pressure being equal to or greater than the target pressure, to cause the metering valve to block the flow of compressed fluid to the motor; and transmit a second control signal, in response to the determined pressure being equal to or greater than the target pressure, to cause the purge valve to vent compressed fluid from the motor.

9. The apparatus of claim 8, wherein the electronic controller is further configured to modify the second control signal, in response to determining that the linear reciprocating motion of the plunger has stopped, to cause the purge valve to cease venting compressed fluid from the motor.

10. The apparatus of claim 1, wherein:

the metering valve comprises a plurality of solenoid valves fluidly coupled in a parallel network; and the electronic controller is configured to transmit one or more control signals that selectively open or close each of the plurality of solenoid valves to control the flow of compressed fluid to the motor.

11. A method comprising:

transmitting a first control signal to a metering valve to cause the metering valve to supply compressed fluid to a motor of a piston pump such that the motor drives linear reciprocating motion of a plunger of the piston pump;

receiving sensor data from a linear encoder coupled to the piston pump, the sensor data being indicative of a position of the plunger of the piston pump;

determining a dispensed volume of a fluid media pumped by the piston pump as a function of the sensor data and a volume-distance calibration factor;

modifying the first control signal, in response to determining that the dispensed volume is equal to or greater than a target volume, to cause the metering valve to cease supplying compressed fluid to the motor;

transmitting a second control signal, in response to determining that the dispensed volume is equal to or greater than a target volume, to a purge valve fluidly coupled between the metering valve and the motor to cause the purge valve to vent compressed fluid from the motor; and wherein determining the dispensed volume comprises:

receiving pressure data from a pressure sensor coupled to an outlet of the piston pump, the pressure data being indicative of a pressure of the fluid media pumped by the piston pump; and disregarding a distance moved by the plunger until the pressure data indicates that the pressure of the fluid media has reached a threshold value.

12. The method of claim 11, further comprising modifying the second control signal, in response to determining that the linear reciprocating motion of the plunger has stopped, to cause the purge valve to cease venting compressed fluid from the motor.

13. The method of claim 11, wherein determining the dispensed volume comprises:

detecting the plunger reaching its end-of-stroke position using the sensor data;

detecting the plunger reaching its pump-start position using the sensor data; and disregarding a distance moved by the plunger between the end-of-stroke position and the pump-start position.

14. The method of claim 11, further comprising transmitting a second control signal that causes a second piston pump to pump a volume of fluid media that is proportional to the dispensed volume.

15. A method comprising:

transmitting a control signal to a metering valve to cause the metering valve to supply compressed fluid to a motor of a piston pump such that the motor drives linear reciprocating motion of a plunger of the piston pump;

receiving sensor data from a linear encoder coupled to the piston pump, the sensor data being indicative of a position of the plunger of the piston pump;

determining a volumetric flow rate of a fluid media pumped by the piston pump as a function of the sensor data and a volume-distance calibration factor;

modifying the control signal as a function of the determined volumetric flow rate and a target volumetric flow rate;

wherein determining the volumetric flow rate comprises:

receiving pressure data from a pressure sensor coupled to an outlet of the piston pump, the pressure data being indicative of a pressure of the fluid media pumped by the piston pump; and disregarding a distance moved by the plunger until the pressure data indicates that the pressure of the fluid media has reached a threshold value.

16. The method of claim 15, wherein determining the volumetric flow rate comprises:

detecting the plunger reaching its end-of-stroke position using the sensor data;

detecting the plunger reaching its pump-start position using the sensor data; and disregarding a distance moved by the plunger between the end-of-stroke position and the pump-start position.

17. The method of claim 15, further comprising transmitting a second control signal that causes a second piston pump to pump fluid media at a volumetric flow rate proportional to the determined volumetric flow rate.

* * * * *